United States Patent [19]

Krolmann et al.

[11] 3,937,277

[45] Feb. 10, 1976

[54] TUBULAR APPARATUS, IN PARTICULAR A STEAM GENERATOR

[75] Inventors: Siegfried Krolmann, Dinslaken-Hiesfeld; Bruno Heinen, Oberhausen, both of Germany

[73] Assignee: Gutehoffnungshutte Sterkrade Aktiengesellschaft, Germany

[22] Filed: Mar. 18, 1974

[21] Appl. No.: 452,251

[30] Foreign Application Priority Data

Mar. 17, 1973 Germany ..... 2313438

[52] U.S. Cl. ..... 165/162; 122/510

[51] Int. Cl.[2] ..... F28F 9/00

[58] Field of Search ..... 165/162; 122/510

[56] References Cited

UNITED STATES PATENTS

| | | | |
|---|---|---|---|
| 3,399,719 | 9/1968 | Forrest et al. | 165/162 |
| 3,420,297 | 1/1970 | Romanos | 165/162 |
| 3,820,594 | 7/1974 | Ritland et al. | 165/162 |

*Primary Examiner*—Wendell E. Burns
*Assistant Examiner*—Theophil W. Streule, Jr.
*Attorney, Agent, or Firm*—Toren, McGeady and Stanger

[57] ABSTRACT

A tubular apparatus, particularly a steam generator, in which U-shaped or straight tubes are inserted in the casing. A series of gratings are provided in the casing and comprise parallel grating elements made up of grating bars and cross-bars formed to firmly hold the tubes in place and separate them from one another. Facilitation of inserting the tubes in the casing is accomplished by emplacing grating elements corresponding to grating elements in other gratings first and continuing in a like manner.

10 Claims, 8 Drawing Figures

TUBULAR APPARATUS, IN PARTICULAR A STEAM GENERATOR

BACKGROUND OF THE INVENTION

The present invention concerns a tubular apparatus, in particular a steam generator, in the casing of which straight or U-shaped tubes are installed which are maintained at a certain distance from each other by unevenly spaced gratings, with the grating bars being fastened in a frame encircling the tube bundle.

Gratings of this type are to eliminate vibrations and prevent any contact of the tubes of the bundle, which are arranged in parallel with a certain clearance. With previously known tubular apparatuses the grating bars are fixed to the frame by welding. As a consequence the gratings are relatively rigid. Further, steam generators are known in which special support beams consisting of steel flats and crossing each other are welded to the frame. These support beams are provided with slots into which the grating bars, which in this case are also welded to the frame, are inserted.

Gratings of this type are fabricated outside the tubular apparatus. As, for reasons of fabrication, the tube bundle cannot be installed in various instances before the shell of the tubular apparatus has been fixed to the tube sheet, the tubes of the bundle must be inserted through the gratings. With tubular apparatuses having a large shell diameter, help in inserting the bars can be given by members of the assembly staff provided manways permitting access are arranged in the grating structures.

SUMMARY OF THE INVENTION

The present invention is aimed at avoiding the disadvantages of previously known tubular apparatuses. The task to be accomplished is to simplify the insertion of the tubes as well as the fabrication of the gratings.

In accordance with the present invention this purpose is achieved on a tubular apparatus of the design specified at the beginning by combining several, parallel grating bars to form a grating element and fixing these elements to the frame. The said elements may consist of bars extending across the frame and which are crossed by cross-bars firmly connected to individual grating bars, preferably by welding.

The grating elements, in turn, are combined to form the complete grating. Gratings consisting of the specified elements can be fabricated in an easier way than previously known gratings, and the jigs required for making the elements are also of a simpler design.

The division of the full grating area into smaller elements in accordance with the present invention further eliminates the disadvantages experienced on a steam generator with gratings of a large diameter. With large dimensions any minor dimensional variation occurring at one end of a grating bar is noticeably felt at the other end as tube-fitting progresses. The individual dimensional variations therefore increasingly add up, the longer the individual bar. In contrast to this, the grating elements according to the present invention can be compared with those in a tubular apparatus of a small diameter, where such difficulties in connection with tube-fitting do not arise.

Furthermore, the use of grating elements permits a new mode of operation to be adopted where the elements are consecutively assembled into a complete grating inside the casing of the tubular apparatus in the course of tube-fitting. The assembly staff working in the casing interior to assist in inserting the tubes meet better operating conditions, and it is further possible to fill the frame with gratings consisting of individual elements, from either frame end.

The grating elements can be arranged at one or at both front faces of the frame, and the individual tubes can be held by all gratings at either or at only one face of the frame, leading to more or less stable tube mounting depending on the requirements to be fulfilled.

BRIEF DESCRIPTION OF THE DRAWINGS

The present invention will be exemplified below by reference to the following Figures.

Figure 1:
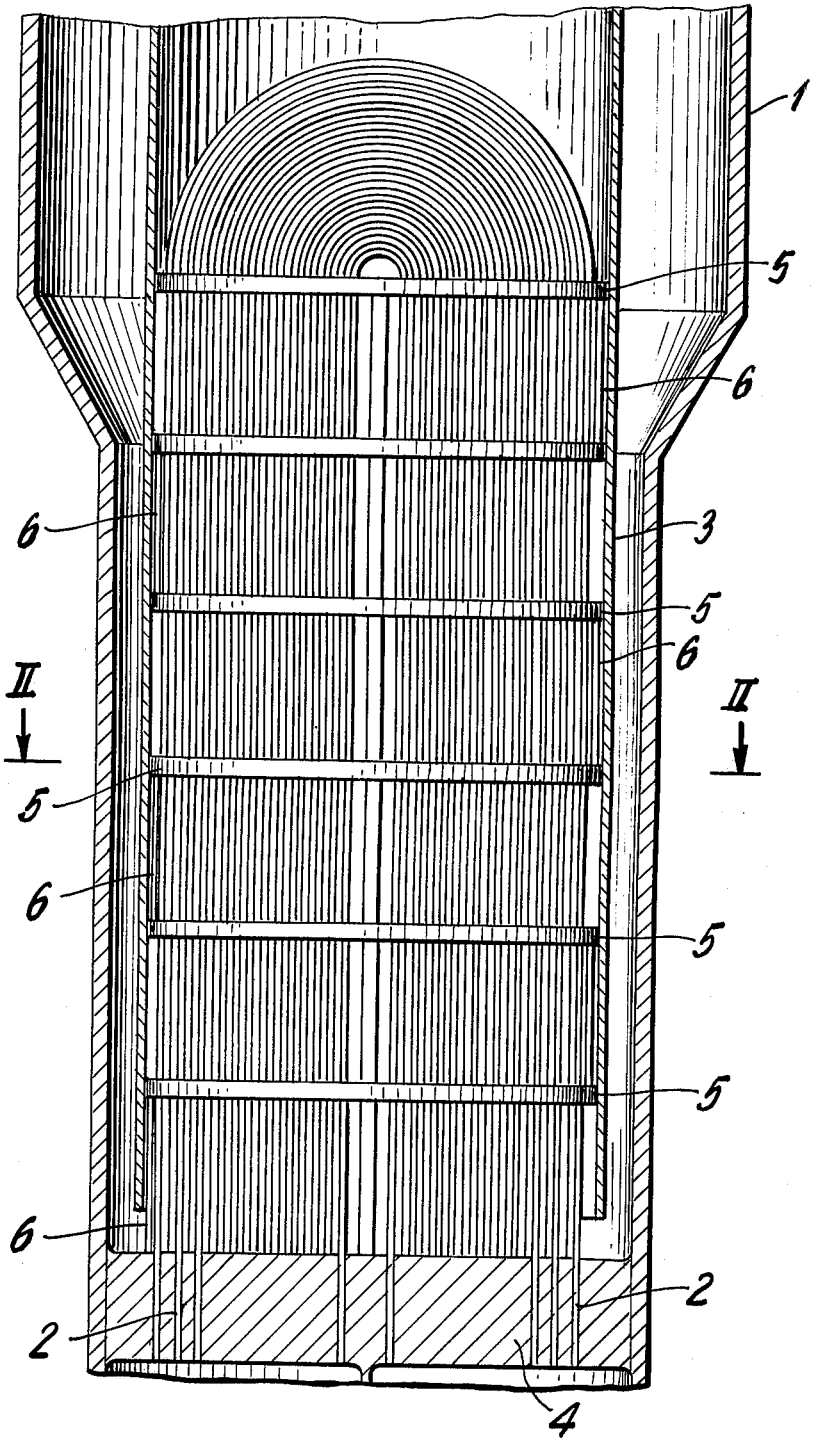
FIG. 1 is a longitudinal section of a tubular apparatus.

The tubular apparatus, in this case a steam generator, consists of a casing 1 into which U-shaped tubes 2 are installed. Within the casing 1 the bundle of tubes 2 is encased in a shell 3 extending to near the tube sheet 4. Instead of U-tubes, straight tubes can be used as well.

The tubes 2 are fixed in the tube sheet 4 which is welded to the casing 1. Assembly of the casing 1 with the tube sheet 4 and shell 3 is made prior to fitting the tubes 2.

Within the shell 3 the tubes 2 are maintained at a certain distance from each other by means of gratings 5. An equal distance between the individual gratings is ensured by the provision of spacers 6.

The grating structures 5 comprise an annular frame 7 with intermediate braces 8, with grating bars 10 inserted in the frame. The various grating bars are combined to form grating elements 9 and bridge the free space between the outer, annular frame 7 and the intermediate braces 8. The grating bars 10 are crossed by cross-bars 11 arranged on the grating bars in a comb-like fashion. With the tube pitch under consideration the cross-bars together with the grating bars form an angle of 60° resp. 120°.

Figure 2:
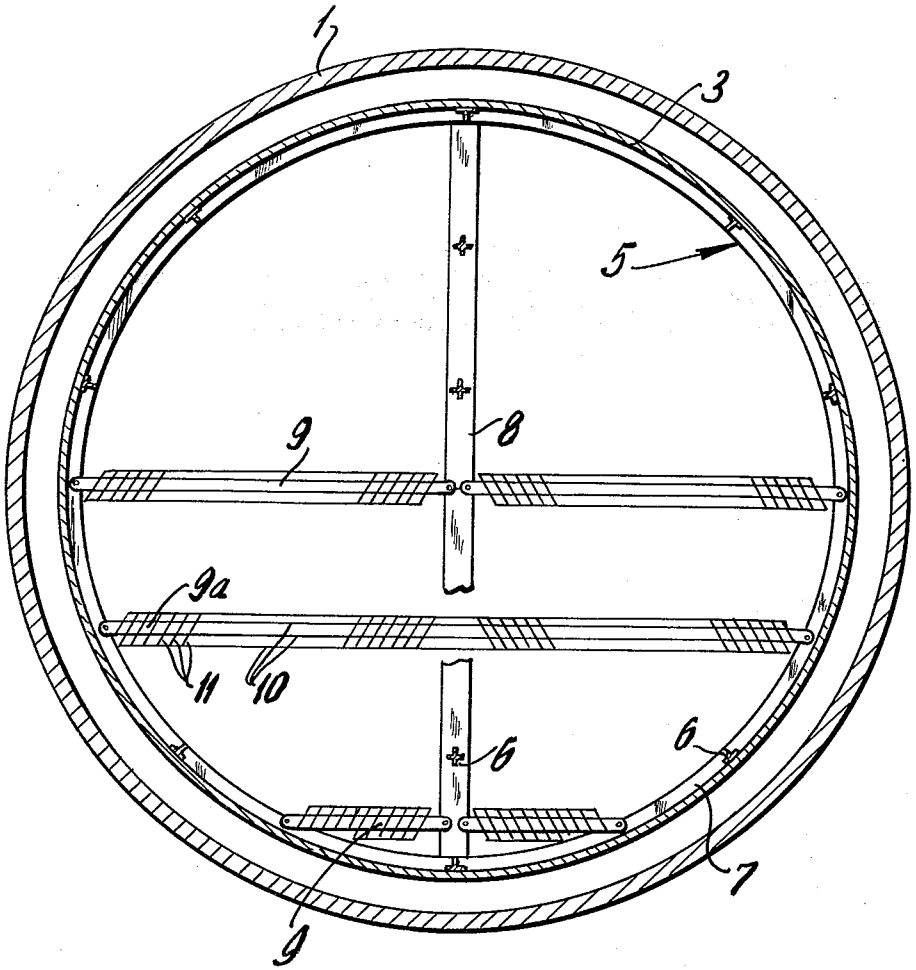
FIG. 2 represents Section II—II of FIG. 1.
Figure 4:
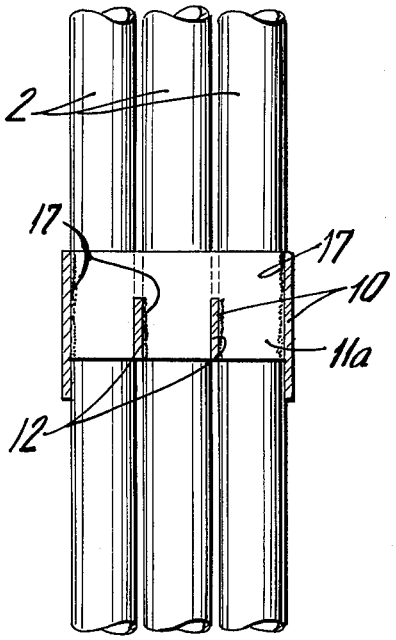
FIG. 4 represents Section IV—IV of FIG. 3.
Figure 5:
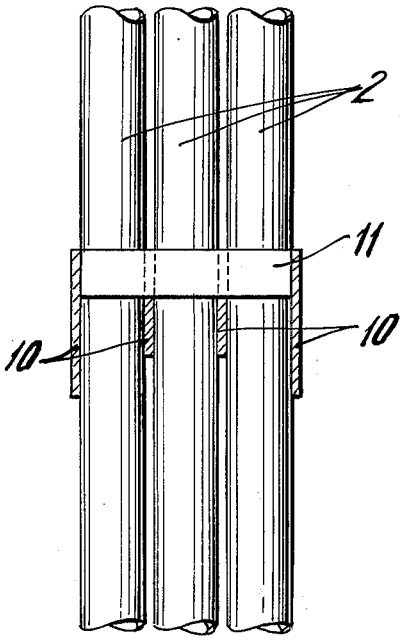
FIG. 5 represents Section V—V of FIG. 3.

The intermediate brace 8 of the grating 5 can be eliminated. In such a case the grating elements extend across the complete annular frame 7. A grating element of this type is marked in FIG. 2 as 9*a*.

The cross-bars 11 are firmly connected to the grating bars 10. Even though this is preferably made by welding, other methods of attachment are also possible. It is not necessary to weld each cross-bar with each grating bar. For instance, only the outer grating bars 10 may be connected, by weld seam 17, with the cross-bars 11. Such an attachment is shown in the upper part of FIG. 3. In this case, the middle grating bars of a grating element 9 are additionally welded to individual cross-bars 11*a*, which are provided with grooves 12 for the middle grating bars to pass through. Cross-bars 11*a* of this design are arranged at a certain spacing, for instance every fifth row of tubes. Alternatively, other than with the above arrangement of weld seams 17, the basic policy can be adopted of welding all middle grating bars to the cross-bars and, at a certain spacing, to the outer grating bars. As any welding operation involves the danger of bar distortion, it may be advisable to provide a weld seam 17 only at the front face of the bar, as is shown in FIG. 6.

Figure 6:
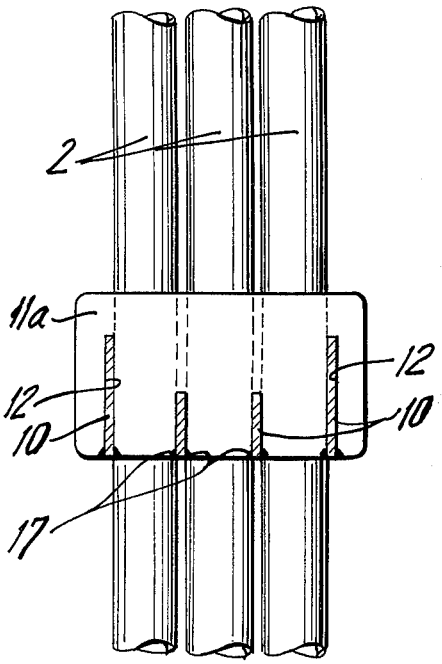
FIGS. 6 and 7 show a different design, represented in the same way as in FIGS. 4 and 5.
Figure 7:
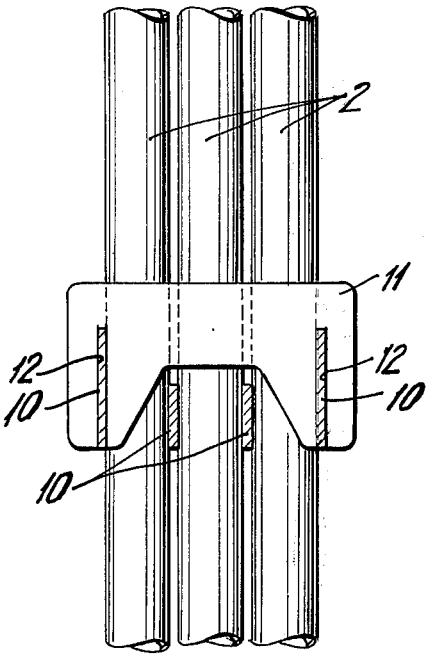

FIGS. 6 and 7 represent another design of cross-bars 11 and 11*a*. In this case the outer grating bars 10 are not attached to the sides of the cross-bars 11, 11*a* but run through grooves 12. With this design it is particularly advisable to have a weld seam 17 only at the front face of the cross-bars 11, 11*a*.

Besides connecting the grating bars 10 to form a grating element 9, 9*a*, the cross-bars 11, 11*a* serve as spacers for the grating bars when they are not welded to each other. For this reason their cross-section is optional.

Figure 3:
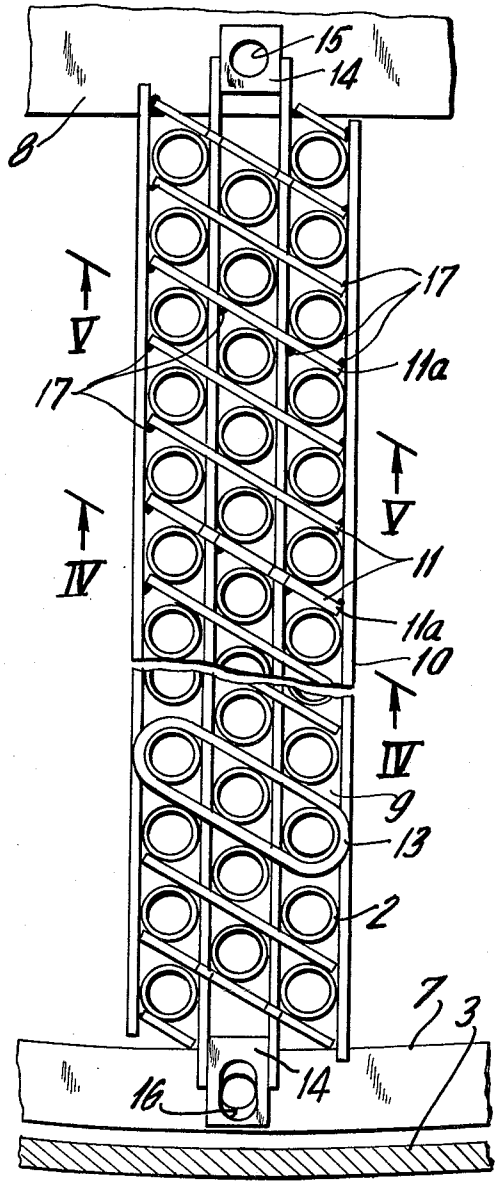
FIG. 3 is a plan view of an individual grating element.

The cross-bars 11 consist of steel flats, but they may also be designed as a continuous band 13 as shown in FIG. 3. In such a case a smaller cross-section can be taken.

In the example under consideration, the grating elements 9 consist of four grating bars 10. The width of the elements depends on the particular design of the tubular apparatus. Wider units are imaginable, for instance for four to five instead of three rows of tubes. At their ends, the grating elements have one or several straps 14 provided with a hole which is in line with another hole 15 in the frame or intermediate brace. By means of bolts (not shown) the grating element is attached to the frame 7 and intermediate brace 8 or, if there is no such brace, only to the frame. At one end of the grating element, the straps 14 are provided with an oblong hole 16. As a consequence, the attachments have one fixed point and one movable point, permitting a certain elongation of the grating elements.

The individual grating elements 9 are consecutively connected with the frame 7. This makes it possible to mount the grating bars from inside the tubular apparatus in the course of tube-fitting, in the following way: First, one grating element 9 is bolted to each frame 7. On frames having intermediate braces 8 two related elements are mounted. Following this, the tubes 2 are inserted through the free space between grating bars 10 and cross-bars 11 and then welded to the tube sheet 4. When all the tubes of a grating element have been inserted, the next element is fixed to the frame and the above sequence of operations repeated. It is possible to fit the tubes from two ends of the frame 7.

Figure 8:
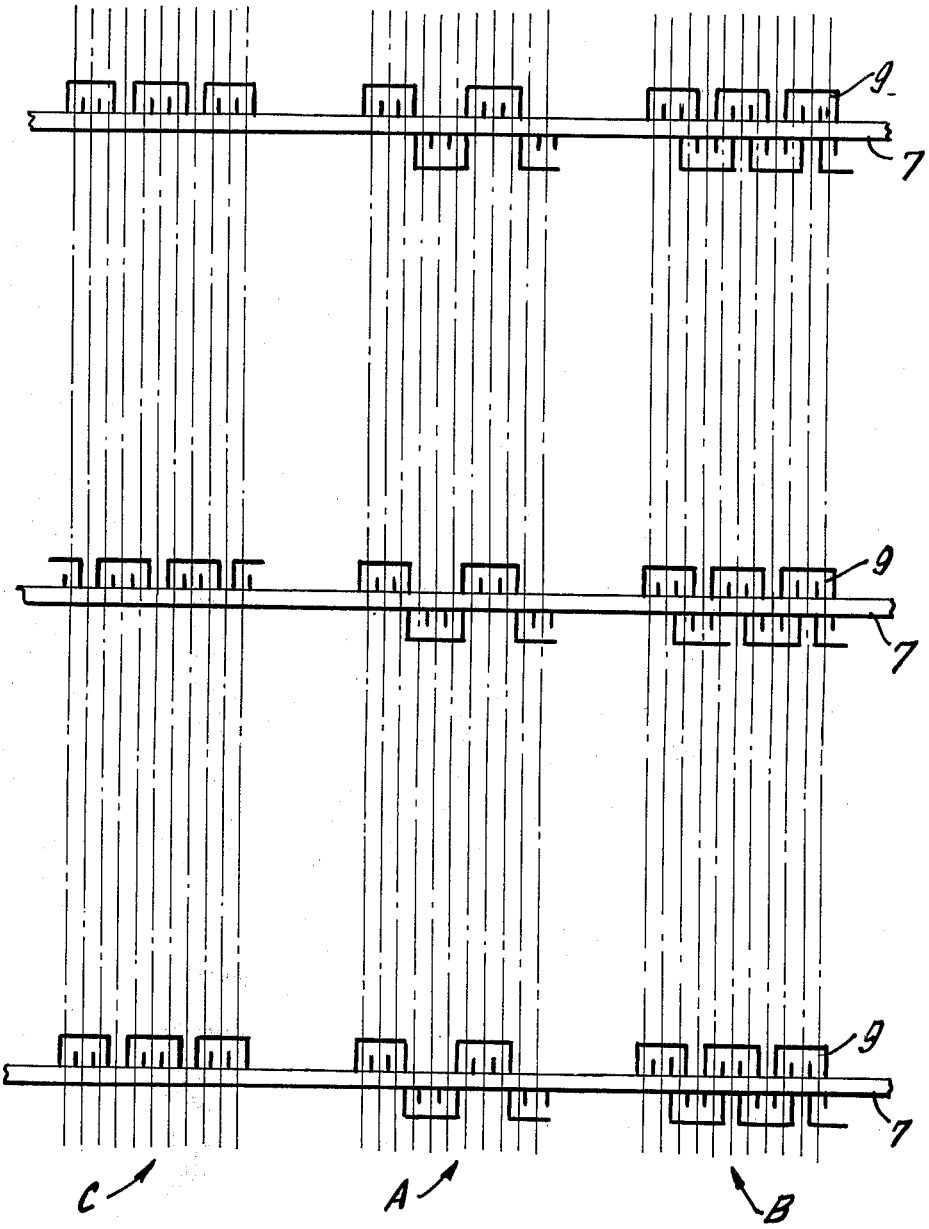
FIG. 8 is a sectional side view of the tube system.

The grating elements 9 specified can be attached to one or both front faces of the frames 7 or intermediate braces 8. As shown in FIG. 8, several modes of assembly are possible. In the case of Alternative A — in the middle of FIG. 8 — the grating elements 9 are attached at both front faces of the frame 7 in such a way that each tube 2 is held at one the other face of the frame. Alternative B — to the right in FIG. 8 — is a similar arrangement, with the exception that the grating elements 9 are located closer to each other so that the tubes 2 extending through the outer free spaces are held twice, whereas the middle tube 2 is confined at one face of the frame 7 by two adjoining grating elements 9. According to Alternative C — to the left in FIG. 8 — the grating elements 9 are arranged at one front face only, with each tube 2 in each frame 7 either extending through the free spaces in a grating element 9 or being confined by two adjoining elements 9. This provides the possibility of more or less stable tube mounting, with Alternative B representing the most and Alternative C the least stable method of those shown in FIG. 8.

For the assembly of the tubular apparatus the frames 7 can be aligned prior to installation. Then the frames are firmly connected by the spacers 6 and inserted in the shell 3 as a whole.

What we claim is:

1. In a tubular apparatus, in particular a steam generator, comprising a casing, a shell within said casing, a tube bundle having a plurality of tubes mounted within said shell, and a number of grating means in said shell for maintaining said tubes at a certain distance from each other, the improvement comprising each of said grating means comprising one ring-shaped frame, and a plurality of longitudinally parallel grating elements secured on said frame, each of said grating elements having a plurality of parallel grating bars, a plurality of cross-bars, each of said cross-bars spanning transversely and at an angle across said plurality of parallel grating bars, and contacting each of said plurality of parallel grating bars, each of said cross-bars comprising means for securing said grating bars to each of said cross-bars, and mounting means at both ends of each of said grating elements for mounting said grating element to said frame, said mounting means being carried by at least one of said plurality of grating bars.

2. The tubular apparatus according to claim 1, wherein each of said grating elements consists of four grating bars.

3. The tubular apparatus according to claim 1, wherein said plurality of grating bars comprises two outer grating bars, each of said cross-bars extending across said plurality of parallel grating bars such that the span thereof does not extend beyond said outer grating bars.

4. The tubular apparatus according to claim 1, wherein said plurality of cross-bars extends longitudinally along said grating bars, and the distance between adjacent ones of said plurality of cross-bars is equal to the outer diameter of one of said tubes, so that each tube is supported by adjacent cross-bars.

5. The tubular apparatus according to claim 4, wherein the distance between adjacent ones of said plurality of grating bars is equal to the outer diameter of one of said tubes, so that each tube is supported between adjacent grating bars.

6. The tubular apparatus according to claim 1, wherein said means for securing all of said grating bars to each of said cross-bars comprises a plurality of grooves formed in said cross-bar.

7. The tubular apparatus according to claim 1, wherein said mounting means comprises two tongues, one of said tongues comprising a circular hole, and the other tongue an oblong hole, said one tongue being mounted between two adjacent grating bars at one end thereof, and said other tongue being mounted between said two adjacent grating bars at the other end thereof, whereby said grating element is secured to said frame.

8. A tubular apparatus according to claim 1, wherein said frame comprises an upper and a lower face, each of said faces mounting said grating elements in an alternate sequence so that the grating elements on the same face are separated by the width of a grating element so each tube is held by one grating element.

9. A tubular apparatus according to claim 1, wherein said frame comprises an upper and a lower face, each of said faces mounting said grating elements in an alternate sequence so that the grating elements on the upper and lower faces are separated from the elements on the same face by a distance less than the width of a grating element so each individual tube is held securely by at least two grating elements.

10. A tubular apparatus according to claim 1, wherein said frame comprises an upper and a lower face, only one face mounting said grating elements so that each individual tube is securely held by one grating element at every other frame.

* * * * *